US012178302B1

(12) United States Patent
Leary

(10) Patent No.: US 12,178,302 B1
(45) Date of Patent: Dec. 31, 2024

(54) HEATED BEARD COMB

(71) Applicant: Sammie Leary, Midlothian, VA (US)

(72) Inventor: Sammie Leary, Midlothian, VA (US)

( * ) Notice: Subject to any disclaimer, the term of this patent is extended or adjusted under 35 U.S.C. 154(b) by 298 days.

(21) Appl. No.: 17/844,823

(22) Filed: Jun. 21, 2022

(51) Int. Cl.
*A45D 2/00* (2006.01)
*A45D 24/06* (2006.01)

(52) U.S. Cl.
CPC ..... *A45D 2/002* (2013.01); *A45D 24/06* (2013.01)

(58) Field of Classification Search
CPC ..... A45D 2/00; A45D 2/002; A45D 1/04; A45D 1/18; A45D 20/48; A45D 20/52; A45D 24/00; A45D 24/06; A45D 24/08; A45D 24/10; A45D 24/18
See application file for complete search history.

(56) References Cited

U.S. PATENT DOCUMENTS 1,349,425 A * 8/1920 Howard ..... A45D 20/48 132/118
1,530,070 A * 3/1925 Bovee ..... A45D 29/20 132/148
1,861,040 A * 5/1932 Jacques ..... A45D 2/002 132/118
2,491,708 A * 12/1949 Bradley ..... A45D 26/0009 132/148
3,731,694 A * 5/1973 Moro ..... A45D 1/04 132/148
3,760,821 A * 9/1973 Weddington ..... A45D 24/10 132/118
3,903,905 A * 9/1975 Tucker ..... A45D 20/50 34/91
3,927,684 A * 12/1975 Lam ..... A45D 20/48 132/119.1
4,743,735 A * 5/1988 Abura ..... H05B 3/46 219/230
6,510,856 B1 * 1/2003 Ahn ..... A41G 5/0086 132/126
6,688,316 B1 * 2/2004 Klug ..... A45D 8/002 211/13.1
2005/0194016 A1 * 9/2005 Yeh ..... A46B 5/0041 132/121
2011/0247641 A1 * 10/2011 Kim ..... A45D 1/04 132/118

FOREIGN PATENT DOCUMENTS

CN 104705972 A * 6/2015

OTHER PUBLICATIONS

CN104705972A. Translation (Year: 2015).*

* cited by examiner

*Primary Examiner* — Cris L. Rodriguez
*Assistant Examiner* — Karim Asqiriba

(57) ABSTRACT

The heated beard comb comprises a handle, a comb, and a heater. The heated beard comb may be a tool for straightening hair in a beard. The comb may fold into the handle when not in use. The comb may unfold to a position in line with the handle for use. The heater may heat a plurality of teeth of the comb to relax the hair as the comb is pulled through the beard. The relaxed hair may be straightened by the pulling of the comb. The heated beard comb may be portable and may be carried in a user's pocket when folded.

18 Claims, 3 Drawing Sheets

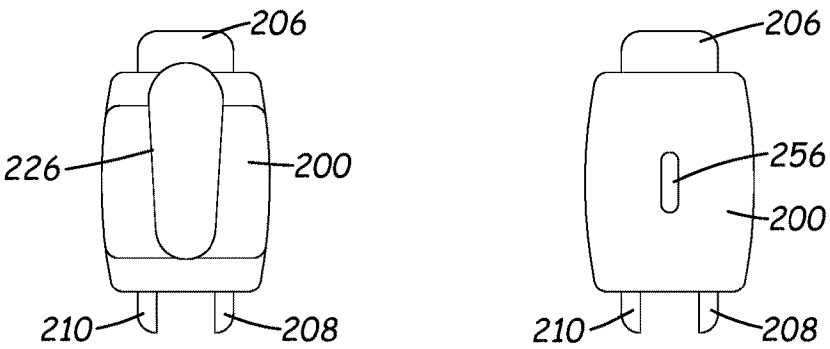
Fig. 3
Fig. 4
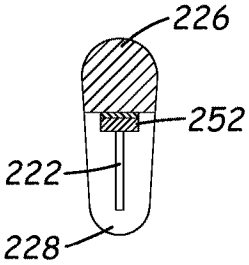
Fig. 5
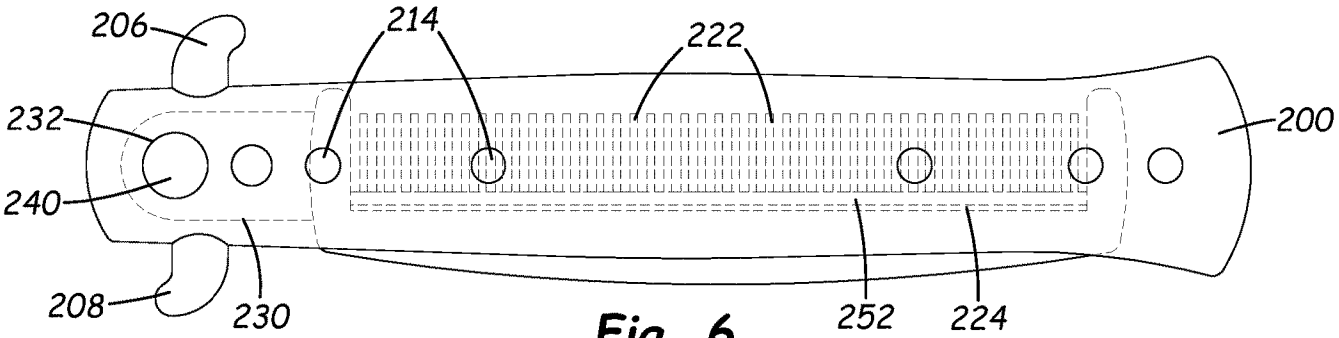
Fig. 6
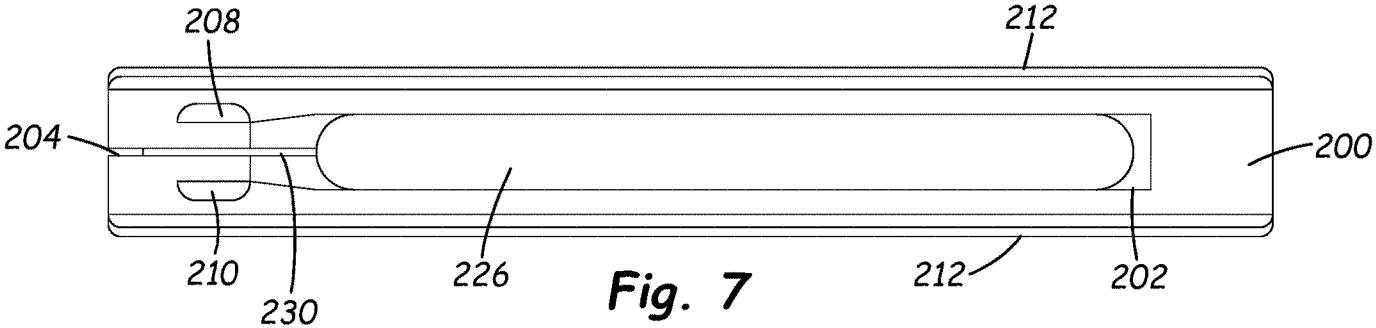
Fig. 7

HEATED BEARD COMB

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of personal grooming and hair styling equipment, more specifically, a heated beard comb.

SUMMARY OF INVENTION

The heated beard comb comprises a handle, a comb, and a heater. The heated beard comb may be a tool for straightening hair in a beard. The comb may fold into the handle when not in use. The comb may unfold to a position in line with the handle for use. The heater may heat a plurality of teeth of the comb to relax the hair as the comb is pulled through the beard. The relaxed hair may be straightened by the pulling of the comb. The heated beard comb may be portable and may be carried in a user's pocket when folded.

An object of the invention is to provide a comb for combing a beard.

Another object of the invention is to provide a heating element to heat the teeth of the comb.

A further object of the invention is to provide a pivot such that the comb may fold into the handle.

Yet another object of the invention is to provide a comb shield with face guards to prevent the user from touching the heating element.

These together with additional objects, features and advantages of the heated beard comb will be readily apparent to those of ordinary skill in the art upon reading the following detailed description of the presently preferred, but nonetheless illustrative, embodiments when taken in conjunction with the accompanying drawings.

In this respect, before explaining the current embodiments of the heated beard comb in detail, it is to be understood that the heated beard comb is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the heated beard comb.

It is therefore important that the claims be regarded as including such equivalent construction insofar as they do not depart from the spirit and scope of the heated beard comb. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

FIG. 3 is a front view of an embodiment of the disclosure

FIG. 4 is a rear view of an embodiment of the disclosure.

FIG. 5 is a cross-sectional view of an embodiment of the disclosure across 5-5 as shown in FIG. 1.

FIG. 6 is a top view of an embodiment of the disclosure, illustrating the invention folded.

FIG. 7 is a side view of a second embodiment of the disclosure, illustrating the invention folded.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
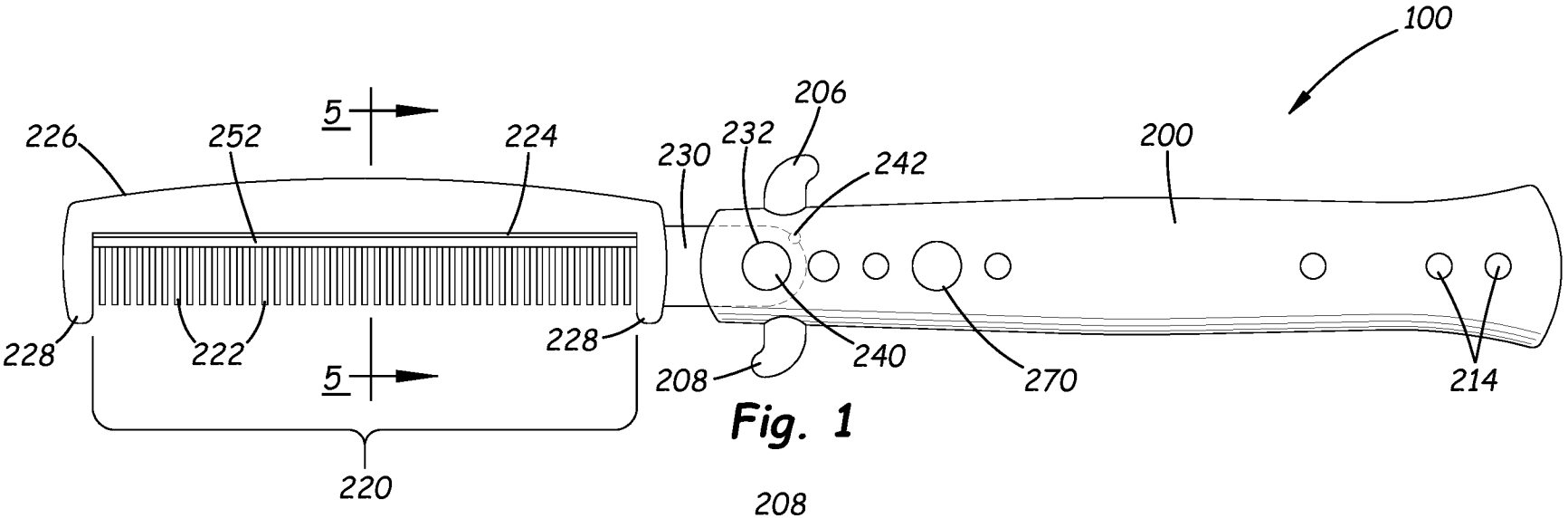
FIG. 1 is a top view of an embodiment of the disclosure, illustrating the invention unfolded.
Figure 2:
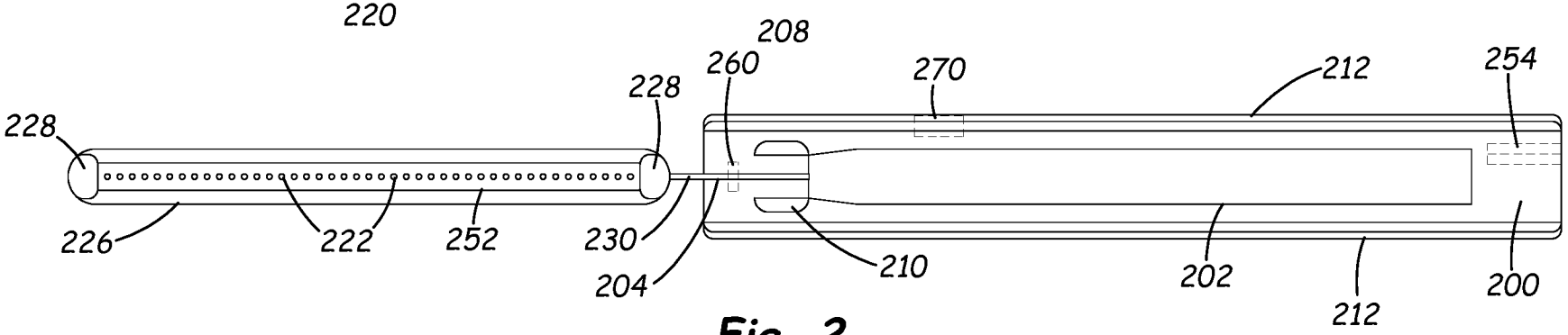
FIG. 2 is a side view of an embodiment of the disclosure, illustrating the invention unfolded.
Figure 8:
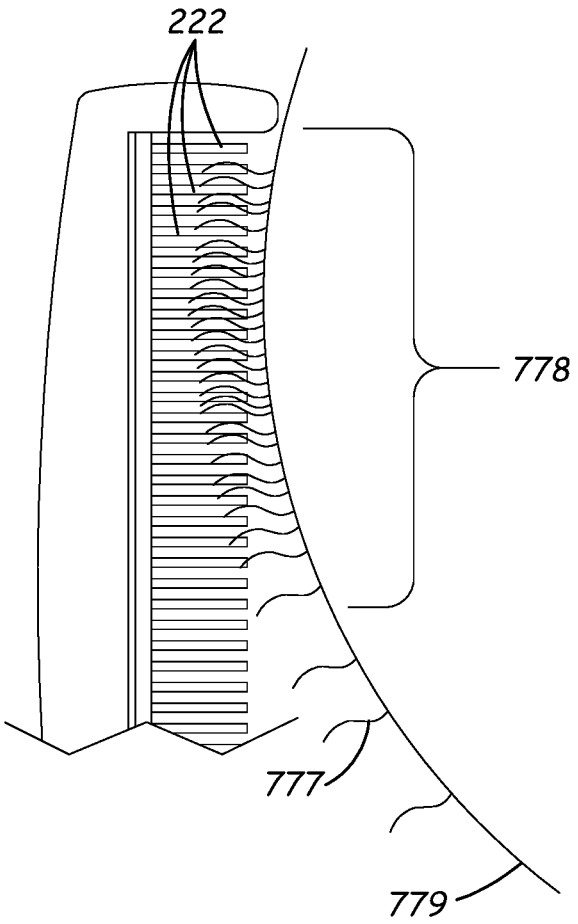
FIG. 8 is a view of the device in use.

Detailed reference will now be made to a first potential embodiment of the disclosure, which is illustrated in FIGS. 1 through 8.

The heated beard comb 100 (hereinafter invention) comprises a handle 200, a comb 220, and a heater. The invention 100 may be a tool for straightening hair 777 in a beard 778 of an end user 779. The comb 220 may fold into the handle 200 when not in use. The comb 220 may unfold to a position in line with the handle 200 for use. The heater may heat a plurality of teeth 222 of the comb 220 to relax the hair as the comb 220 is pulled through the beard. The relaxed hair may be straightened by the pulling of the comb 220. The invention 100 may be portable and may be carried in a user's pocket when folded.

The handle 200 may be a housing for the comb 220 when the comb 220 is not in use. The handle 200 may be adapted for a user to grasp when the comb 220 is in use. The handle 200 may comprise a cavity 202 into which the comb 220 folds when closed. The cavity 202 may be accessible on a side of the handle 200. A 19 pivot 240 may be located at the front of the handle 200. The pivot 240 may pivotably couple a tang 230 of the comb 220 to the handle 200 such that the comb 220 may fold into and unfold from the handle 200. A tang slot 204 may be a slot at the front of the handle 200 that couples to the cavity 202 and provides clearance for the tang 230 to pass during folding and unfolding of the comb 220.

The handle 200 may comprise a first finger stop 206 and a second finger stop 208 located at the front of the handle 200 on opposing sides of the handle 200. The first finger stop 206 and the second finger stop 208 may be adapted to prevent a user's fingers from sliding forward off of the handle 200 during use. The second finger stop 208 may comprise a gap 210 such that the 9 comb 220 may pivot without interferences from the second finger stop 208.

In some embodiments, the handle 200 may comprise one or more decorative trim pieces 212 that may be coupled to the top and/or bottom of the handle 200.

The handle 200 may comprise one or more rivets 214. The one or more rivets 214 may be functional, decorative, or both. As non-limiting examples, the one or more rivets 214 may fasten subassemblies of the handle 200 together, may secure the one or more decorative trim pieces 212 to the handle 200, or both. In some embodiments, the first finger stop 206, the second finger stop 208, and the one or more decorative trim pieces 212 of the handle 200 may ornamentally mimic the appearance of a switchblade when the comb 220 is folded into the handle 200.

The comb 220 may comprise the plurality of teeth 222, a spine 224, and the tang 230. The plurality of teeth 222 may be parallel coplanar armatures separated by diastemata. The plurality of teeth 222 may be coupled to the spine 224. The spine 224 may be oriented to run longitudinally along the comb 220. The plurality of teeth 222 may be oriented to be perpendicular to the spine 224. The plurality of teeth 222 may be made of thermally conducting material. The plurality of teeth 222 may be heated by a heating element 252.

As non-limiting examples, the plurality of teeth 222 may be made of a thermally conducting metal such as aluminum alloys, copper alloys, or stainless steel alloys. In some embodiments, the spine 224 may be made from the same material as the plurality of teeth 222.

A comb shield 226 may be coupled to the comb 220. The comb shield 226 may be made from a thermally insulating material. The comb shield 226 may be adapted to cover the spine 224 and the ends of the comb 220 to prevent the user from touching the comb 220, which may be hot.

The comb shield 226 may comprise face guards 228 which May be extensions of the side of the comb shield 226 adapted to prevent the tips of the plurality of teeth 222 from touching a user's face. The face guards 228 may extend farther away from the spine 224 than the free ends of the plurality of teeth 222 do.

The tang 230 may comprise a tang pivot aperture 232. The pivot 240 may pass through the tang 230 at the tang pivot aperture 232 and may pivotably couple the comb 220 to the handle 200.

In some embodiments, the invention 100 may comprise a pivot lock 242. The pivot lock 242 may hold the comb 220 open once the comb 220 has been maximally opened. As non-limiting examples, the pivot lock 242 may be a spine lock, a frame lock, a compression lock, a button lock, or combinations thereof.

The heater may be a battery-operated circuit that heats the comb 220 when activated. The heater may comprise the heating element 252 and one or more batteries 254. The heating element 252 may be a resistive element that produces heat when an electrical current passes through the heating element 252. The heating element 252 may be located on the comb 220 in contact with the plurality of teeth 222 and/or the spine 224.

The one or more batteries 254 may comprise one or more energy-storage devices. The one or more batteries 254 may be a source of electrical energy to operate the heating element 252. The one or more batteries 254 may be rechargeable and/or replaceable. The one or more batteries 254 may be housed in the handle 200. A recharging port 256 located at the end of the handle 200 may be detachably coupled to an external power adapter to recharge the one or more batteries 254.

The electrical energy may be transferred from the one or more batteries 254 in the handle 200 to the heating element 252 in the comb 220 via heater contacts 260 where the tang 230 meets the handle 200. As non-limiting examples, an upper tang heater contact coupled to the top surface of the tang 230 may contact an upper handle heater contact coupled to the inside top of the handle 200 and a lower tang heater contact coupled to the bottom surface of the tang 230 may contact a lower handle heater contact coupled to the inside bottom of the handle 200 when the comb 220 is unfolded.

In some embodiments, an on/off control 270 accessible on the outside of the handle 200 may control the flow of electrical energy form the one or more batteries 254 to the heating element 252 such that the heating element 252 may heat when the on/off control 270 is in the ON position and the flow of electrical energy may cease when the on/off control 270 is in the OFF position.

In use, the one or more batteries 254 may be recharged by plugging the external power adapter into the recharging port 256. The invention 100 may be unfolded by pivoting the comb 220 out of the cavity 202 until the comb 220 is aligned with the handle 200. The heating element 252 may heat-either because the heater contacts 260 have aligned and made contact or because the heater contacts 260 have aligned and the on/off control 270 has been actuated. The heating element 252 may heat the plurality of teeth 222. As the comb 220 is be pulled through the beard, the heat may cause the hair to relax. The relaxed hair 19 may be pulled straight by the comb 220.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting 8 example, the upper end of a vertical shaft is the top end of the 9 vertical shaft.

As used in this disclosure, an "aperture" may be an opening in a surface or object. Aperture may be synonymous with hole, slit, crack, gap, slot, or opening.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, a "cavity" may be an empty space or negative space that is formed within an object.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw. In some embodiments, a control may alter an electrical property of a circuit such as resistance, inductance, or capacitance.

As used herein, the words "couple", "couples", "coupled" or "coupling", may refer to connecting, either directly or indirectly, and does not necessarily imply a mechanical connection.

As used in this disclosure, "decorative" may be an adjective that refers to a first object or item that is used with a second object or item of the purpose of making the second object or item more attractive and/or more distinct. Decorative will generally, but not necessarily, imply making the second object or item more attractive visually.

As used in this disclosure, a "diastema" (plural diastemata) may be the space between two teeth.

As used herein, "front" may indicate the side of an object that is closest to a forward direction of travel under normal use of the object or the side or part of an object that normally presents itself to view or that is normally used first. "Rear" or "back" may refer to the side that is opposite the front. As used herein, "handle" may refer to an object by which a tool, object, or door is held or manipulated with the hand.

As used in this disclosure, a "heating element" may be a resistive wire that is used to convert electrical energy into heat. As non-limiting examples, common metals used to form heating elements include a combination of nickel and chromium, a combination of iron, chromium and aluminum, a combination of copper, nickel, iron, and manganese, or platinum.

As used in this disclosure, a "housing" may be a rigid or semi-rigid casing that encloses and protects one or more devices.

As used herein, the word "longitudinal" or "longitudinally" may refer to a lengthwise or longest direction.

As used herein, the word "pivot" may include any mechanical arrangement that allows for rotational motion. Non-limiting examples of pivots may include hinges, holes, posts, dowels, pins, points, rods, shafts, balls, and sockets, either individually or in combination.

As used herein, the word "portable" may refer to a device that may be carried by a single person and may be used at multiple locations. In some cases, portable may imply that the device may be used while being carried.

As used in this disclosure, a "slot" may be a narrow groove, cut, opening, or aperture that is formed in or through 8 an object.

As used herein, "thermally insulated/thermally insulating" may refer to a property of a material that reduces the transfer of heat through the material. "Thermal insulation" may refer to a material having the property of being thermally insulating.

As used in this disclosure, a "tool" may be a device, an apparatus, or an instrument that is used to carry out an activity, operation, or procedure.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A heated beard comb comprising:
a handle, a comb, and a heater;
wherein the heated beard comb is a tool for straightening hair in a beard;
wherein the comb folds into the handle when not in use;
wherein the comb unfolds to a position in line with the handle for use;
wherein the heater heats a plurality of teeth of the comb to relax the hair as the comb is pulled through the beard;
wherein the relaxed hair is straightened by the pulling of the comb;
wherein the heated beard comb is portable;
wherein the handle is a housing for the comb when the comb is not in use;
wherein the handle comprises a cavity into which the comb folds when closed;
wherein the cavity is accessible on a side of the handle;
wherein a pivot is located at the front of the handle;
wherein the pivot pivotably couples a tang of the comb to the handle such that the comb folds into and unfolds from the handle;
wherein the handle comprises one or more decorative trim pieces that are coupled to the top and/or bottom of the handle;
wherein the heater is a battery-operated circuit that heats the comb when activated;
wherein the heater comprises the heating element and one or more batteries;
wherein the heating element is a resistive element that produces heat when an electrical current passes through the heating element;
wherein the heating element is located on the comb in contact with the plurality of teeth.

2. The heated beard comb according to claim 1,
wherein the handle is adapted for a user to grasp when the comb is in use;
wherein a tang slot is a slot at the front of the handle that couples to the cavity and provides clearance for the tang to pass during folding and unfolding of the comb.

3. The heated beard comb according to claim 2,
wherein the handle comprises a first finger stop and a second finger stop located at the front of the handle on opposing sides of the handle;
wherein the first finger stop and the second finger stop are adapted to prevent a user's fingers from sliding forward off of the handle during use.

4. The heated beard comb according to claim 3,
wherein the second finger stop comprises a gap such that the comb pivots without interferences from the second finger stop.

5. The heated beard comb according to claim 4,
wherein the handle comprises one or more rivets;
wherein the one or more rivets are functional, decorative, or both.

6. The heated beard comb according to claim 5,
wherein the one or more rivets fasten subassemblies of the handle together, secure the one or more decorative trim pieces to the handle, or both.

7. The heated beard comb according to claim 6,
wherein the first finger stop, the second finger stop, and the one or more decorative trim pieces of the handle ornamentally mimic the appearance of a switchblade when the comb is folded into the handle.

8. The heated beard comb according to claim 4,
wherein the comb comprises the plurality of teeth, a spine, and the tang;
wherein the plurality of teeth are parallel coplanar armatures separated by diastemata;
wherein the plurality of teeth are coupled to the spine;
wherein the spine is oriented to run longitudinally along the comb;
wherein the plurality of teeth are oriented to be perpendicular to the spine;
wherein the plurality of teeth are made of thermally conducting material;
wherein the plurality of teeth are heated by a heating element.

9. The heated beard comb according to claim 8,
wherein the plurality of teeth are made of a thermally conducting metal.

10. The heated beard comb according to claim 8,
wherein the spine is made from the same material as the plurality of teeth.

11. The heated beard comb according to claim 8,
wherein a comb shield is coupled to the comb;
wherein the comb shield is made from a thermally insulating material;
wherein the comb shield is adapted to cover the spine and the ends of the comb to prevent the user from touching the comb.

12. The heated beard comb according to claim 11,
wherein the comb shield comprises face guards which are extensions of the side of the comb shield adapted to prevent the tips of the plurality of teeth from touching a user's face;
wherein the face guards extends farther away from the spine than the free ends of the plurality of teeth do.

13. The heated beard comb according to claim 12,
wherein the tang comprises a tang pivot aperture;
wherein the pivot passes through the tang at the tang pivot aperture and pivotably couples the comb to the handle.

14. The heated beard comb according to claim 13,
wherein the heated beard comb comprises a pivot lock;
wherein the pivot lock holds the comb open once the comb has been maximally opened.

15. The heated beard comb according to claim 13,
wherein the one or more batteries comprise one or more energy-storage devices;
wherein the one or more batteries are a source of electrical energy to operate the heating element;
wherein the one or more batteries are rechargeable and/or replaceable;
wherein the one or more batteries are housed in the handle;
wherein a recharging port located at the end of the handle is detachably coupled to an external power adapter to recharge the one or more batteries.

16. The heated beard comb according to claim 15,
wherein the electrical energy is transferred from the one or more batteries in the handle to the heating element in the comb via heater contacts where the tang meets the handle.

17. The heated beard comb according to claim 16,
wherein an upper tang heater contact coupled to the top surface of the tang contacts an upper handle heater contact coupled to the inside top of the handle and a lower tang heater contact coupled to the bottom surface of the tang contacts a lower handle heater contact coupled to the inside bottom of the handle when the comb is unfolded.

18. The heated beard comb according to claim 15, wherein an on/off control accessible on the outside of the handle controls the flow of electrical energy form the one or more batteries to the heating element such that the heating element heats when the on/off control is in the ON position and the flow of electrical energy ceases when the on/off control is in the OFF position.

* * * * *